US007559740B2

(12) United States Patent
Bigi et al.

(10) Patent No.: US 7,559,740 B2
(45) Date of Patent: Jul. 14, 2009

(54) PROTECTION DEVICE FOR A TURBINE STATOR

(75) Inventors: Manuele Bigi, Florence (IT); Piero Iacopetti, Pistoia (IT); Alessandro Ciani, Florence (IT)

(73) Assignee: Nuovo Pignone S.p.A. (IT)

( * ) Notice: Subject to any disclaimer, the term of this patent is extended or adjusted under 35 U.S.C. 154(b) by 68 days.

(21) Appl. No.: 10/595,855

(22) PCT Filed: Sep. 14, 2005

(86) PCT No.: PCT/EP2005/009997

§ 371 (c)(1),
(2), (4) Date: May 16, 2006

(87) PCT Pub. No.: WO2006/029889

PCT Pub. Date: Mar. 23, 2006

(65) Prior Publication Data

US 2007/0147994 A1 Jun. 28, 2007

(30) Foreign Application Priority Data

Sep. 17, 2004 (IT) ..... MI2004A1780

(51) Int. Cl.
*F28F 7/00* (2006.01)

(52) U.S. Cl. ..... 415/136; 415/173.1; 416/191

(58) Field of Classification Search ..... 415/136, 415/138, 173.1, 173.2, 173.3, 173.6, 175, 415/176, 177, 178; 416/189, 191
See application file for complete search history.

(56) References Cited

U.S. PATENT DOCUMENTS 3,146,992 A * 9/1964 Farrell ..... 415/12
3,346,175 A * 10/1967 Wiles ..... 415/200
3,408,044 A * 10/1968 Burger et al. ..... 415/117
3,730,640 A * 5/1973 Rice et al. ..... 415/117
3,860,358 A * 1/1975 Cavicchi et al. ..... 415/173.1
4,032,253 A * 6/1977 Ryncosky et al. ..... 415/136
4,135,851 A * 1/1979 Bill et al. ..... 415/173.3
4,177,004 A * 12/1979 Riedmiller et al. ..... 415/116
4,222,707 A * 9/1980 Drouet et al. ..... 415/116
4,784,569 A * 11/1988 Sidenstick et al. ..... 415/173.1
5,071,313 A * 12/1991 Nichols ..... 415/134
5,127,793 A 7/1992 Walker et al.
6,340,285 B1 * 1/2002 Gonyou et al. ..... 415/116
6,340,286 B1 * 1/2002 Aksit et al. ..... 415/173.3
6,361,273 B1 * 3/2002 Eng et al. ..... 415/173.1

(Continued)

FOREIGN PATENT DOCUMENTS

EP 1154126 A 11/2001

(Continued)

*Primary Examiner*—Edward Look
*Assistant Examiner*—Aaron R Eastman
(74) *Attorney, Agent, or Firm*—Global Patent Operation

(57) ABSTRACT

Protection device for a stator of a turbine comprising a series of annular sectors (12) which can be coupled by connection means, each sector (12) comprising a first side surface (13) which has at least one cavity (14) equipped with a bottom (15), each bottom (15) of the at least one cavity (14) is convex and each sector (12) comprises at least one stiffening rib (16) positioned inside the at least one cavity (14) and having a variable section in a longitudinal direction to modulate the rigidity of each sector (12).

14 Claims, 2 Drawing Sheets

U.S. PATENT DOCUMENTS

| | | | | |
|---|---|---|---|---|
| 6,390,769 | B1 * | 5/2002 | Burdgick et al. | 415/116 |
| 6,607,350 | B2 * | 8/2003 | Dodd | 415/14 |
| 2004/0005216 | A1 * | 1/2004 | Suzumura et al. | 415/173.3 |
| 2005/0089401 | A1 * | 4/2005 | Phipps | 415/178 |
| 2005/0276690 | A1 * | 12/2005 | Amiot et al. | 415/178 |

FOREIGN PATENT DOCUMENTS

| | | | | |
|---|---|---|---|---|
| EP | 1162346 | A | | 12/2001 |
| EP | 1178182 | A | | 2/2002 |
| EP | 1225305 | A | | 7/2002 |
| JP | 62153504 | A | * | 7/1987 |

* cited by examiner

PROTECTION DEVICE FOR A TURBINE STATOR

This application claims benefit of PCT International Application number PCT/EP05/009997 filed on Sep. 14, 2005 and Italian Application number MI2004A001780 filed on Sep. 17, 2004, the contents of which are incorporated herein by reference in their entirety.

The present invention relates to a protection device for a turbine stator.

A gas turbine is a rotating thermal machine which converts the enthalpy of a gas into useful work, using gases coming from a combustion and which supplies mechanical power on a rotating shaft.

The turbine therefore normally comprises a compressor or turbo-compressor, inside which the air taken from the outside is brought under pressure.

Various injectors feed the fuel which is mixed with the air to form a air-fuel ignition mixture.

The axial compressor is entrained by a so-called turbine, or turbo-expander, which supplies mechanical energy to a user transforming the enthalpy of the gases combusted in the combustion chamber.

In applications for the generation of mechanical energy, the expansion jump is subdivided into two partial jumps, each of which takes place inside a turbine. The high-pressure turbine, downstream of the combustion chamber, entrains the compression. The low-pressure turbine, which collects the gases coming from the high-pressure turbine, is then connected to a user.

The turbo-expander, turbo-compressor, combustion chamber (or heater), outlet shaft, regulation system and ignition system, form the essential parts of a gas turbine plant.

As far as the functioning of a gas turbine is concerned, it is known that the fluid penetrates the compressor through a series of inlet ducts.

In these canalisations, the gas has low-pressure and low-temperature characteristics, whereas, as it passes through the compressor, the gas is compressed and its temperature increases.

It then penetrates into the combustion (or heating) chamber, where it undergoes a further significant increase in temperature.

The heat necessary for the temperature increase of the gas is supplied by the combustion of gas fuel introduced into the heating chamber, by means of injectors.

The triggering of the combustion, when the machine is activated, is obtained by means of sparking plugs.

At the outlet of the combustion chamber, the high-pressure and high-temperature gas reaches the turbine, through specific ducts, where it gives up part of the energy accumulated in the compressor and heating chamber (combustor) and then flows outside by means of the discharge channels.

In the inside of a turbine there is a stator 100, equipped with a series of stator blades in which a rotor 110, also equipped with a series of blades (rotor), is housed and is capable of rotating, said rotor being rotated as a result of the gas.

The protection device of the stator, also known as "shroud", together with the platform of stator blades, defines the main gas flow.

The function of the shroud is to protect the outer cases, which are normally made of low-quality materials and therefore have a low resistance to corrosion, from oxidation and deterioration.

The shroud generally consists of a whole ring, or is suitably divided into a series of sectors, each of which is cooled with a stream of air coming from a compressor.

The cooling can be effected with various techniques which essentially depend on the combustion temperature and temperature decrease to be obtained.

The type of protection device to which the present invention relates comprises a series of sectors, assembled to form a ring, each of which has a cavity situated on the outer surface of each sector.

In the case of machines with a high combustion temperature, the most widely used cooling technique is that known as "impingement".

According to this technique, a sheet is fixed, preferably by means of brazing, on each cavity of each sector, said sheet equipped with a series of pass-through holes through which fresh air coming from a compressor is drawn for the cooling of the shroud itself, in particular by the impact of said air on the bottom surface of said cavity and its subsequent discharge from a series of outlet holes situated in each sector, not shown in the figures.

In spite of these expedients, even if an efficient cooling is effected, the shroud and therefore also each of its sectors, is subject to deformation due to thermal gradients and to the operating temperature of the turbine which create a deformed configuration different from that at room temperature, i.e. with respect to a rest configuration in which the turbine is not operating.

As a result of the thermal gradients which develop during the functioning of the turbine, a non-uniform deformation is created of the shroud and in particular of each of its sectors.

Shrouds are therefore normally produced using super-alloys coated with suitable materials for limiting the temperatures thereon.

A first disadvantage is that this causes deformations at the operating temperatures which limit deformations but do not allow the clearances to be reduced to the minimum for the danger of possible friction between the shroud and blades with which the rotor is equipped.

Another disadvantage is that by increasing the rigidity of the shroud, the stress increased by the thermal gradients also increases, with a consequent brusque reduction in the useful life of the shroud itself.

This causes a deterioration in the reliability of the gas turbine in which the shroud is installed and also the maintenance costs as the shroud must be substituted more frequently to keep the turbine in a good state and avoid sudden stoppages.

An objective of the present invention is to provide a protection device for a turbine stator which allows a reduction in the clearances and at the same time maintains a high useful life.

A further objective is to provide a protection device for a turbine stator which has a high rigidity maintaining low stress on the protection device itself.

Another objective is to provide a protection device for a turbine stator which increases the performances of the turbine itself.

Yet another objective is to provide a protection device for a turbine stator which is simple and economical These objectives according to the present invention are achieved by providing a protection device for a stator of a gas turbine as specified in claim 1.

Further characteristics of the invention are indicated in the subsequent claims.

The characteristics and advantages of a protection device of a stator of a gas turbine according to the present invention will appear more evident from the following illustrative and non-limiting description, referring to the schematic drawings enclosed, in which.

Figure 1:
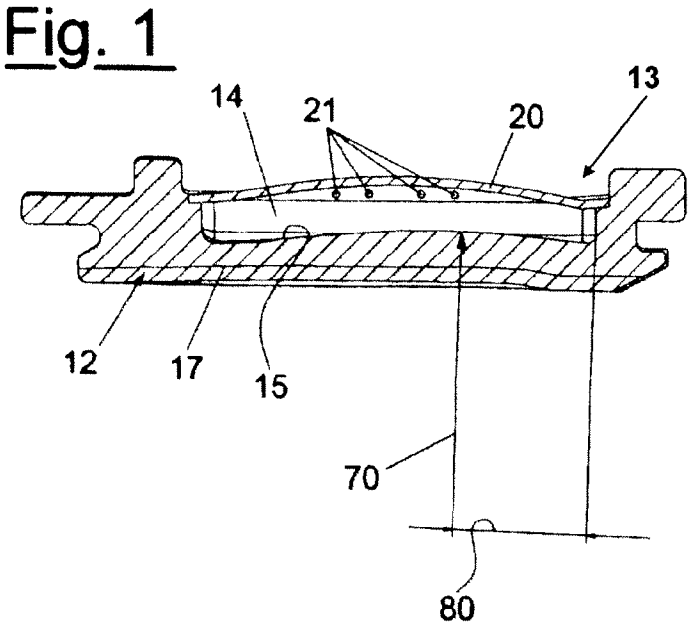
FIG. 1 is a raised longitudinal sectional view of a sector of a preferred embodiment of a protection device 10 of a gas turbine rotor 110 according to the present invention.
Figure 3:
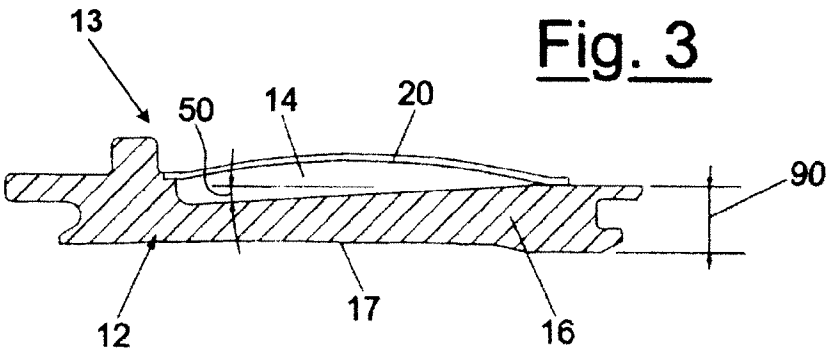
FIG. 3 is a raised sectional side view according to the line III-III of FIG. 2.
Figure 2:
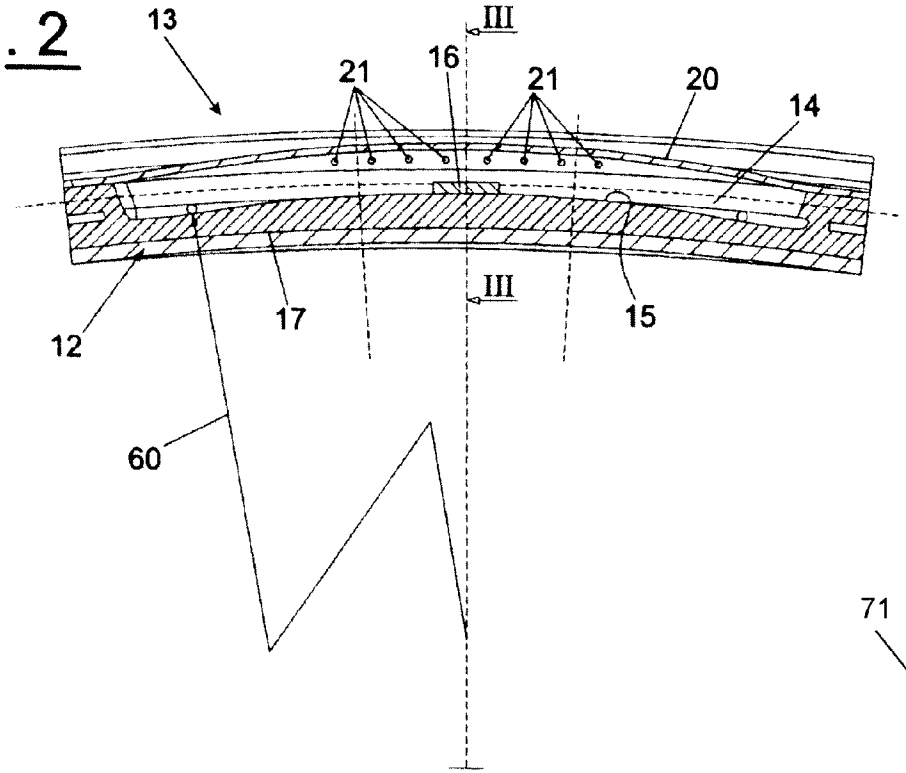
FIG. 2 is a raised sectional radial view of the sector of FIG. 1.
Figure 4:
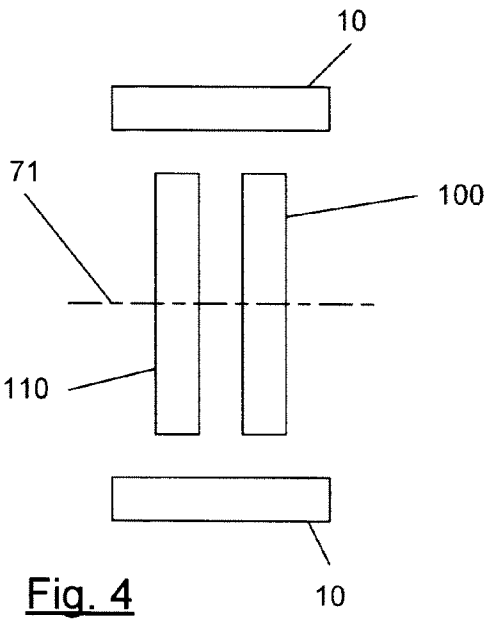
FIG. 4 is a schematic view of a portion or a turbine illustrating a stator, a rotor and the protection device of FIG. 1.

With reference to the figures, these show a protection device 10 for a turbine stator 100 comprising a series of annular sectors 12 which can be coupled by connection means, each sector 12 comprising a first side surface 13 which has at least one cavity 14 having a bottom 15, each sector 12 comprises at least one stiffening rib 16 positioned inside said at least one cavity 14 and having a variable section in a longitudinal direction to modulate the rigidity of each sector 12.

Furthermore, each bottom 15 of said at least one cavity 14 is also convex to modulate the rigidity of each sector 12.

Said bottom 15 is preferably convex in a circumferential and/or axial direction, so as to obtain a variable section of the shroud.

This produces a variable rigidity of the shroud which, during the functioning of the turbine, has a uniform circumferential and/or axial deformation and therefore a low state of stress.

At the same time, minimum clearances are obtained, which are such as to guarantee an increase in the efficiency of the turbine, also maintaining a high useful life of the shroud.

Said convex bottom 15 preferably has an apex which, in an axial section, has an axial curvature radius 70 which, adimensionalised with respect to the radius of the rotor, i.e. divided by the radius of the rotor, has a value preferably ranging from 0.221 to 0.299.

Said adimensionalised axial curvature radius 70 is preferably 0.260.

In a radial section, said apex preferably has a circumferential curvature radius 60 which, adimensionalised with respect to the radius of the rotor, i.e. divided by the radius of the rotor, has a value preferably ranging from 0.365 to 0.494.

Said adimensionalised circumferential curvature radius 60 is preferably 0.429.

Said apex in an axial section preferably has a distance 80 from one end of said at least one cavity 14, said distance 80 adimensionalised with respect to an axial length of said at least one cavity 14, has a value ranging from 0.142 to 0.192.

Said adimensionalised distance 80 is preferably 0.167.

With respect to the axis of the turbine 71, said rib 16 along an axial direction is preferably tilted by an angle 50 preferably ranging from 3.162° to 4.278°.

Said angle 50 is preferably 3.72°.

In other words, a resistant axial section of the rib 16 varies linearly along the axis of the turbine 71, so as to balance the thermal gradient along the axis 71 of the turbine.

Said rib 16 has a maximum axial height 90 which, adimensionalised with respect to the axial length of the at least one cavity 14, i.e. divided by said axial length, has a value preferably ranging from 0.133 to 0.180.

Said adimensionalised maximum axial height 90 is preferably 0.156.

Each sector 12 also comprises a sheet 20 equipped with a series of pass-through holes 21 for the introduction of air for the cooling of the sector 12 itself.

Said sheet is fixed to the corresponding sector 12, or is preferably integral therewith, so as to cover the at least one cavity 14.

It can thus be seen that a protection device for a turbine stator according to the present invention achieves the objectives specified above.

The protection device for a turbine stator of the present invention thus conceived can undergo numerous modifications and variants, all included in the same inventive concept.

Furthermore, in practice, the materials used, as also the dimensions and components, can vary according to technical demands.

The invention claimed is:

1. A protection device for a stator of a turbine comprising a series of annular sectors which can be coupled by a connector, each sector comprising a first side surface which has at least one cavity equipped with a bottom, wherein each bottom of said at least one cavity is convex and in that each sector comprises at least one stiffening rib positioned inside said at least one cavity and having a variable section in a longitudinal direction to modulate the rigidity of each sector.

2. The protection device according to claim 1, wherein said bottom is convex in a circumferential and/or axial direction.

3. The protection device according to claim 1 or 2, wherein said convex bottom has an apex which in an axial section has an axial curvature radius which, divided by the radius of the rotor, has a value preferably ranging from 0.221 to 0.299.

4. The protection device according to claim 3, wherein said axial curvature radius, divided by the radius of the rotor, has a value equal to 0.260.

5. The protection device according to claim 3, wherein said apex in a radial section has a circumferential curvature radius which, divided by the radius of the rotor, has a value preferably ranging from 0.365 to 0.494.

6. The protection device according to claim 5, wherein said circumferential curvature radius, divided by the radius of the rotor, has a value equal to 0.429.

7. The protection device according to claim 3, wherein a distance from one end of said at least one cavity to said apex in an axial section divided by an axial length of said at least one cavity has a value ranging from 0.142 to 0.192.

8. The protection device according to claim 7, wherein said distance divided by an axial length of said at least one cavity has a value equal to 0.167.

9. The protection device according to claim 1, wherein with respect to the axis of the turbine, said rib along an axial direction is tilted by an angle which ranges from 3.1620° to 4.2780°.

10. The protection device according to claim 9, wherein said angle is 3.72°.

11. The protection device according to claim 1, wherein said rib has a maximum axial height which, divided by the axial length of said at least one cavity has a value ranging from 0.133 to 0.180.

12. The protection device according to claim 11, wherein said maximum axial height, divided by the axial length of said at least one cavity has a value equal to 0.156.

13. The protection device according to claim 1, wherein each sector comprises a sheet equipped with a series of pass-through holes which is fixed to said at least one cavity.

14. The protection device according to claim 13, wherein said sheet is integral with the corresponding sector of said series of sectors.

* * * * *